US008523382B1

(12) United States Patent
Bush et al.

(10) Patent No.: US 8,523,382 B1
(45) Date of Patent: Sep. 3, 2013

(54) FLUORESCENT LAMP FIXTURE AND METHOD OF DISSIPATING HEAT FROM SAME

(75) Inventors: Michael Bush, Saint Charles, MO (US); Charles S. Oldani, Saint Louis, MO (US)

(73) Assignee: Koller Enterprises, Inc., Fenton, MO (US)

( * ) Notice: Subject to any disclaimer, the term of this patent is extended or adjusted under 35 U.S.C. 154(b) by 231 days.

(21) Appl. No.: 13/192,546

(22) Filed: Jul. 28, 2011

(51) Int. Cl.
*F21V 21/00* (2006.01)
*F21V 29/00* (2006.01)

(52) U.S. Cl.
USPC ..... 362/217.1; 362/260; 362/217.13; 362/218; 362/221; 362/373

(58) Field of Classification Search
USPC ..... 362/217.01, 218, 221, 222, 260, 362/294, 373, 217.08, 217.1, 217.13, 265
See application file for complete search history.

(56) References Cited

U.S. PATENT DOCUMENTS 5,207,504 A * 5/1993 Swift et al. ..... 362/260

* cited by examiner

*Primary Examiner* — Thomas Sember
(74) *Attorney, Agent, or Firm* — Stinson Morrison Hecker LLP

(57) ABSTRACT

A fluorescent lamp fixture for mounting a ballast and at least one fluorescent lamp and a method of dissipating heat from the same is disclosed. The fixture comprises a molded housing defining a groove and a hat-shaped metal strip having an outer wall with at least two surfaces in contact with the sides of the groove and at least one flange in contact with the top of the housing. The metal strip also has a pair of inner walls positioned relative to the outer wall so as to define a chamber. At least one fastener is slidably held by the strip such that a portion of the fastener is retained within the chamber and slides along the inner walls. The fastener secures a ballast in direct contact with the flanges whereby heat from the ballast is transferred to the metal strip and dissipated from the housing during use.

12 Claims, 3 Drawing Sheets

FLUORESCENT LAMP FIXTURE AND METHOD OF DISSIPATING HEAT FROM SAME

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

The present invention relates to a fluorescent lamp fixture for mounting a ballast and at least one fluorescent lamp. Fluorescent lamp fixtures are used in a variety of settings including residential, commercial, and industrial buildings. The fluorescent lamps mounted in such fixtures provide light in an energy efficient manner. In general, fluorescent lamps are gas-discharged lamps that use electricity to excite mercury atoms in a gas-filled tube. The excited mercury atoms emit short-wave ultraviolet light, which in turn causes a phosphor coating on the lamp to fluoresce thereby producing visible light. Fluorescent lamp fixtures often initially cost more than incandescent lamp fixtures because fluorescent lamp fixtures require a ballast. The ballast is used to regulate the current flowing through the lamp. Without a ballast to control the current, the fluorescent lamp will blow out. The ballast can also provide the striking voltage required to light the lamp. The life of a ballast is affected by heat. If the ballast is exposed to high temperatures for an extended period of time, it will degrade. Some fluorescent light fixtures known in the art provide a shield or other insulating material to isolate the ballast away from the heat emitted from the fluorescent lamp. Ballasts are typically rated for use at a maximum case temperature of 85° C.-90° C.

At one time it was standard practice to construct a fluorescent lamp fixture housing out of metal. It was also known that heat dissipation was promoted by connecting the ballast directly to the metal housing. In recent years, housings molded from a resinous material have become popular and offer cost advantages, weight savings, and durability. The practice of mounting the ballast directly to the housing was discontinued with the molded housings because the heat from the ballast could deform the resinous material and jeopardize the integrity of the connection between the ballast and the housing. Instead, the standard practice with molded housings has been to mount the ballast spaced from the housing so that there is an air space between the two. Surprisingly, with the present invention the use of a metal strip inserted into a groove in the housing and used to mount the ballast to the housing has been found to offer several advantages.

First, by mounting the ballast directly to the metal strip, heat dissipation is promoted—resulting in a lower temperature within the housing when compared to the prior art construction where the ballast is mounted spaced from the housing.

Second, the metal strip, which is sandwiched between the ballast and the housing, precludes damage to the molded housing from the heat of the ballast.

Third, use of the metal strip provides a secure attachment point for the ballast so that in the event of excessive heat, such as upon ballast failure, the connector for the ballast remains structurally intact and precludes failure at the attachment point, which would not be the case if the ballast was affixed directly to the molded housing.

Fourth, the use of the metal strip facilitates attachment of the ballast without t drilling holes in the housing which is labor intensive and could negatively impact the structural integrity of the housing.

Fifth, the utilization of the metal strip provides for an unlimited number of positions along the length of the housing where the ballast may be mounted, which is not possible when holes are drilled in the housing or predrilled holes are utilized.

BRIEF SUMMARY OF THE INVENTION

The fixture of the invention comprises a molded housing having a top and sides and is designed for use with a ballast and a fluorescent lamp. The top of the housing defines a groove that extends along a major portion of the length of the housing. The groove presents three sides and an opening. The fluorescent lamp fixture also comprises a hat-shaped metal strip having a protrusion and two flanges. The protrusion has three surfaces, each of which is in contact with a side of the groove. The flanges extend outside of the groove and contact the top of the housing. The metal strip secures the ballast in direct contact with the flange, whereby heat from the ballast is transferred to the metal strip and dissipated from the housing during use.

In a preferred embodiment, the strip protrusion comprises an outer wall and a pair of inner walls. The inner walls are positioned relative to the outer wall so as to define a chamber within the protrusion. In this embodiment, a fastener is slidably held by the inner walls of the metal strip such that a portion of the fastener is retained within the chamber and the fastener can slide along the length of the strip.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
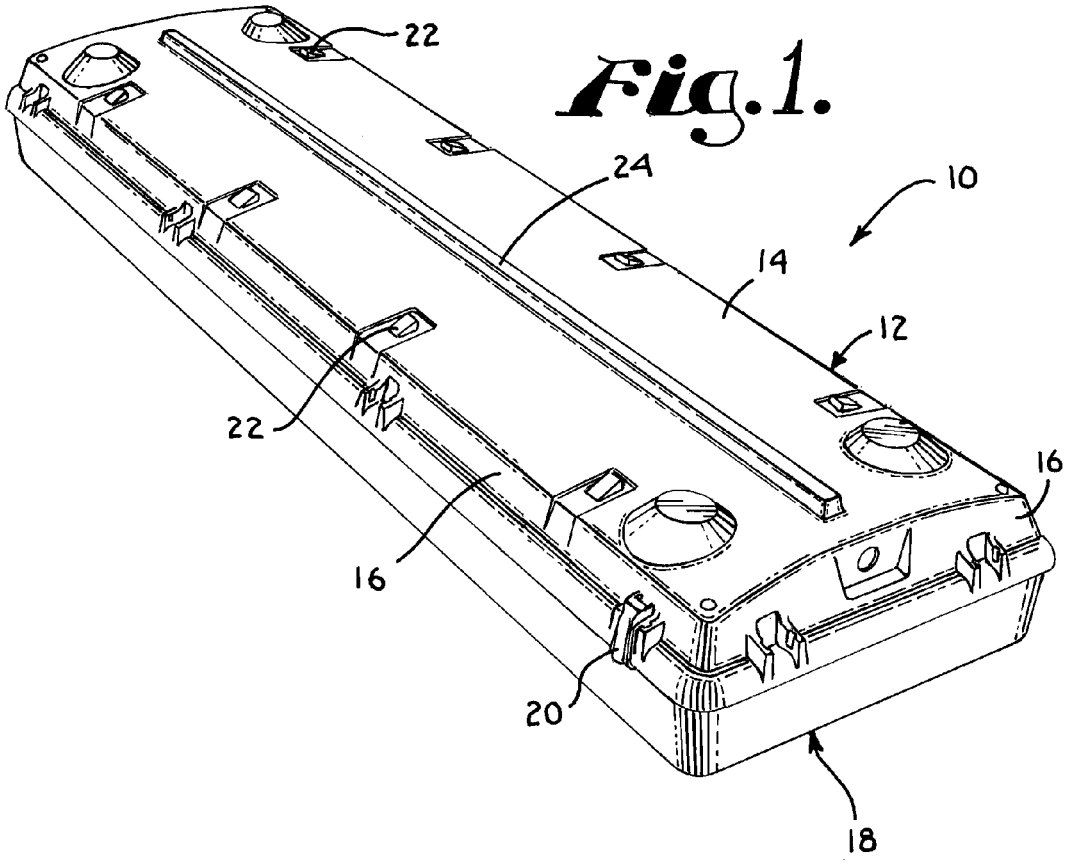
FIG. 1 is a perspective view of the preferred embodiment of the fluorescent lamp fixture when viewed from the top.
Figure 2:
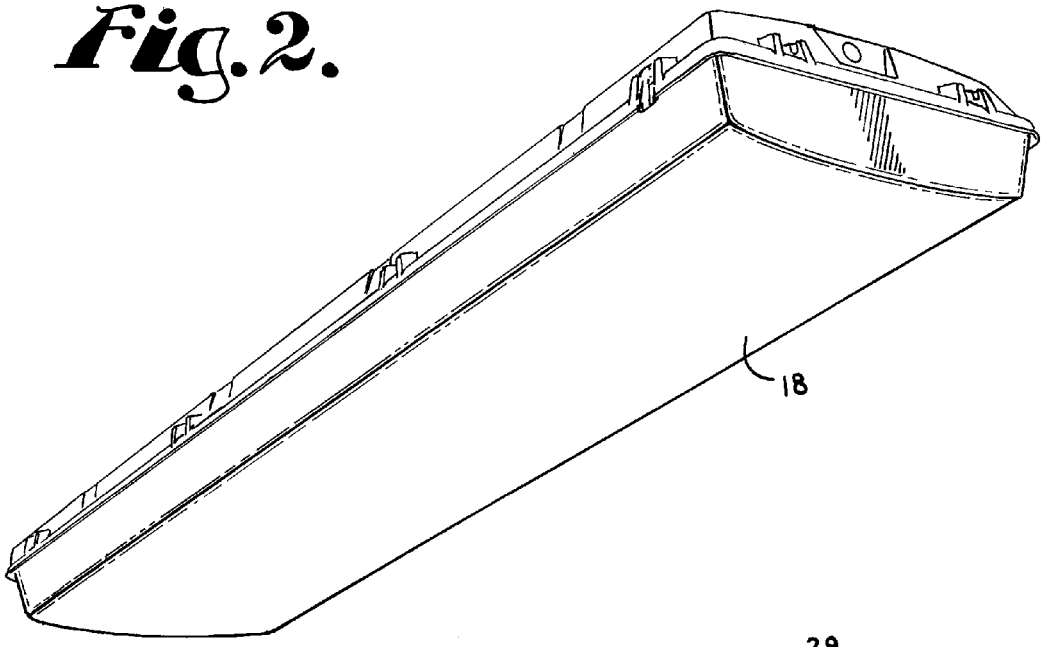
FIG. 2 is a perspective view of the preferred embodiment of the fluorescent lamp fixture when viewed from the bottom.

With reference to FIG. 1, the fluorescent lamp fixture 10 is shown. Fixture 10 comprises a housing 12 molded from a resinous material and having a top 14 and sides 16. Housing 12 is coupled with lens 18 using clamps 20 mounted on housing sides 16. Clamp 20 is shown in FIG. 1 and similar clamps (not shown) are provided at intervals around housing 12. Housing 12 also includes a number of tabs 22, which are used to hold brackets (not shown) that mount fixture 10 to a surface such as a ceiling. With reference to FIG. 2, lens 18 is shown coupled with housing 12. Lens 18 is made from a transparent or translucent material through which visible light from a fluorescent lamp may pass. Lens 18 has been removed in FIG. 3 to show additional details of housing 12.

Figure 3:
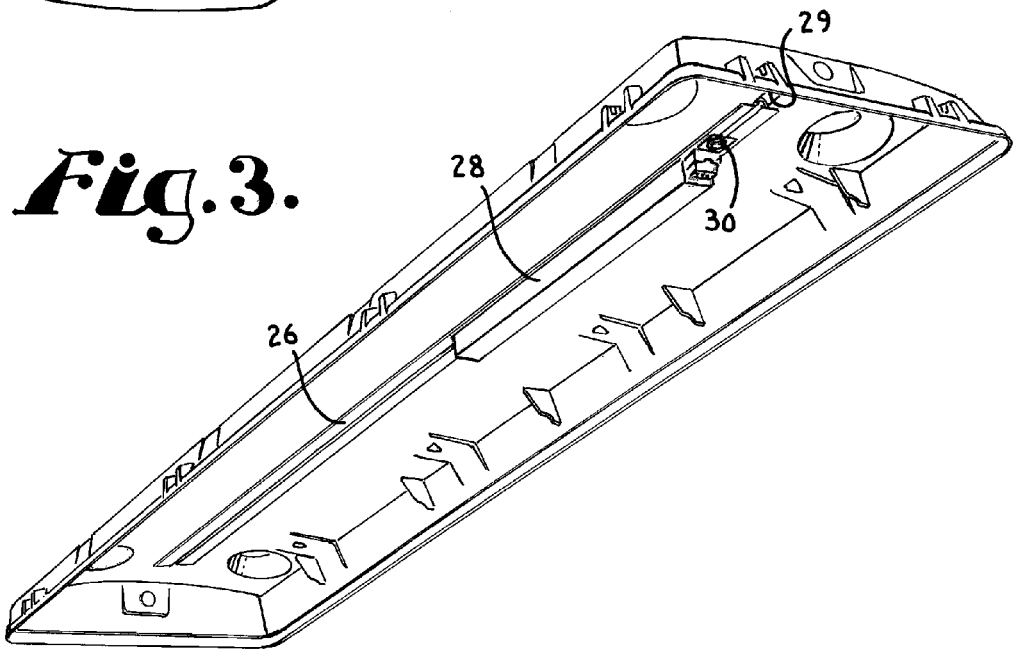
FIG. 3 is a perspective view of the housing of the preferred embodiment of the fluorescent lamp fixture when viewed from the bottom.

As shown in FIGS. 1 and 3, housing top 14 includes a raised portion defining a groove 24. In the preferred embodiment, groove 24 has three sides at approximately right angles to one another. Groove 24 extends above the top surface of housing top 14 and along a major portion of the length of housing top 14. As the term is used throughout the specification and claims, "major portion" means more than 50% of the total length of housing top 14. A hat-shaped metal strip 26 fits partially within groove 24 as shown in FIG. 3. Strip 26 is made of a heat conductive material, which is preferably metal and most preferably aluminum. With reference to FIG. 3, a ballast 28 is shown mounted to strip 26 using a fastener 30. A second fastener 30 (not shown) secures the opposite end of ballast 28.

Figure 4:
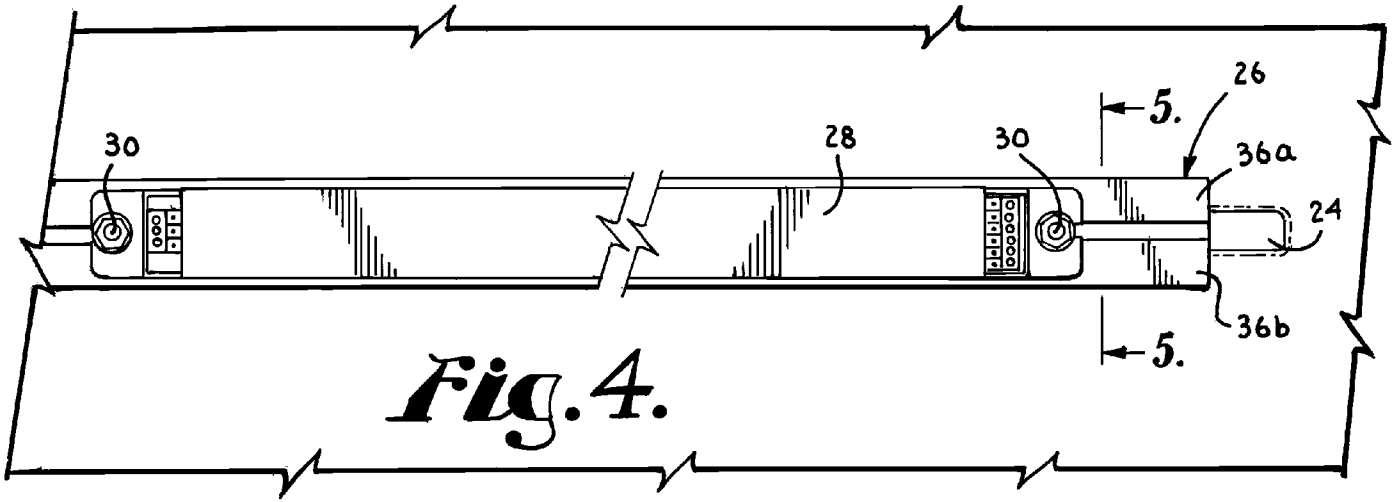
FIG. 4 is a detailed bottom view of the housing of the preferred embodiment of the fluorescent lamp fixture.

With reference to FIG. 4, a detailed view of the bottom of housing 12 is shown. As previously explained, strip 26 is hat shaped; it has a protrusion 37 and two flanges 36*a* and 36*b*. Protrusion 37 (shown in FIG. 5 and described below) is secured within groove 24. Flanges 36*a* and 36*b* extend outside of groove 24 and are in contact with housing top 14. Ballast 28 is mounted directly to flanges 36*a* and 36*b* using fasteners 30. In this position, at least one surface of ballast 28 is in direct contact with at least one surface of strip 26.

Figure 5:
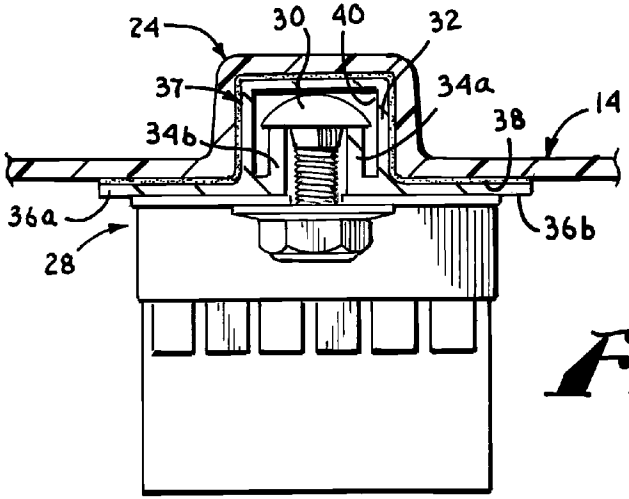
FIG. 5 is a cross-sectional view of the preferred embodiment of the fluorescent lamp fixture taken along line 5 as shown in FIG. 4.

With reference to FIG. 5, a cross-section of housing 12 and metal strip 26 is shown. Protrusion 37 extends at a right angle relative to flanges 36*a* and 36*b* and presents three flat surfaces at right angles to one another such that each of the three surfaces is in contact with a side of groove 24. Flanges 36*a* and 36*b* extend outside and on either side of groove 24. As shown in FIG. 5, strip 26 is fixed to the sides of groove 24 and housing top 14 using an adhesive 38. In the preferred embodiment, metal strip 26 has an outer wall 32 and a pair of inner walls 34*a* and 34*b*. As described above, outer wall 32 is in contact with the sides of groove 24. Inner walls 34*a* and 34*b* are positioned relative to outer wall 32 such that outer wall 32 and inner walls 34*a* and 34*b* define a chamber 40 within protrusion 37. Inner walls 34*a* and 34*b* form rails over which fastener 30 rides while a portion of fastener 30 is retained in chamber 40. In the preferred embodiment, fastener 30 is a carriage bolt having a head with a width that is greater than the space between inner walls 34*a* and 34*b*. In this manner, fastener 30 can slide along the length of strip 26 to accommodate ballasts having varying lengths and mount ballasts in various positions along strip 26. As shown in FIGS. 4 and 5, ballast 28 is mounted in direct contact with flanges 36*a* and 36*b* using fasteners 30.

During use, ballast 28 generates heat. The heat generated by the ballast, in combination with heat generated by the fluorescent lamps mounted in the fixture, creates an environment where the life of ballast 28 is adversely affected. Thus, dissipation of heat is of utmost importance. In the present invention, heat is conducted away from ballast 28 by metal strip 26 due to the direct contact between ballast 28 and metal strip 26. The surfaces of metal strip 26 in contact with housing top 14 then allow heat to dissipate out of housing 12. By dissipating the heat from the fluorescent lamp fixture in this manner, the life of ballast 28 is extended.

The utilization of metal strip 26 for mounting ballast 28 provides a secure attachment structure that is not jeopardized in the event of a sharp rise in temperature, which may result from ballast failure. Even if sufficient heat is generated to soften the resinous material from which the housing is molded, the metal strip spreads the weight of the ballast over a relatively large area, and there is metal-to-metal contact at the point of connection. The configuration of strip 26 also offers the advantage of being able to mount the ballast anywhere along the length of the strip by simply sliding fasteners 30 to the desired location. This is accomplished without the need for drilling or molding holes into the housing. Moreover, the hat-shaped metal strip increases the surface area from which the heat from the ballast can dissipate by having protrusion 37 in contact with more than one side of groove 24. This construction is highly effective in dissipating heat from the fixture.

The term "hat shaped" used in this application is intended to encompass all of the above and any other configurations where there are at least two sides in contact with the sides of a corresponding shaped groove and at least one flange extending away from the groove and in contact with the top of the housing. Although a hat-shaped strip having a three-sided protrusion as shown in FIG. 5 is preferred, protrusion 37 may (in cross section) alternatively have two surfaces and be triangle shaped, have more than three surfaces and be polyhedron shaped, or have a curved surface such that it is round or oblong shaped. A serpentine configuration will provide additional surface area and may also be used. In these alternative embodiments, a housing having a groove presenting a shape that corresponds with the shape of the protrusion and permits contact between the surfaces of the protrusion and the sides of the groove is used to maximize the surface area from which heat may dissipate. In addition, although strip 26 having two continuous flanges is preferred as it maximizes the direct contact with the ballast, strip 26 may have a single flange or a segmented flange. A strip having either of these alternative constructions would require less material than a strip with two continuous flanges, which may result in cost or weight savings.

Although only a single ballast is shown in FIG. 3, multiple ballasts may be used within a single fluorescent lamp fixture. Strip 26 can accommodate any number fasteners used to secure the desired number of ballasts. In the preferred embodiment shown in FIG. 4, additional fasteners may be added to the fixture by inserting the head of the fastener into groove 24 and sliding it towards strip 26 until the fastener head engages inner walls 34*a* and 34*b* within protrusion 37. Other fasteners known in the art, including hooks, clamps, and screws may alternatively be used to secure each ballast to strip 26.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A fluorescent lamp fixture for mounting a ballast and at least one fluorescent lamp, said fixture comprising:

a molded housing having a top and sides, said top having a groove extending along a major portion of the length of said housing, said groove presenting at least two sides and an opening;

a hat-shaped metal strip comprising a protrusion with at least two surfaces in contact with said sides of said groove, and at least one flange extending outside of said groove for contact with said housing top, said metal strip adapted to secure the ballast in direct contact with said flange, whereby heat from the ballast is transferred to said metal strip and dissipated from said housing during use.

2. The fluorescent lamp fixture of claim 1, wherein said hat-shaped metal strip further comprises two flanges.

3. The fluorescent lamp fixture of claim 1, wherein said protrusion has three sides.

4. The fluorescent lamp fixture of claim 1, wherein said protrusion further comprises an outer wall and a pair of inner walls, wherein said inner walls are positioned relative to said outer wall so as to define a chamber within said protrusion.

5. The fluorescent lamp fixture of claim 4, further comprising at least one fastener slidably held by said strip, wherein a portion of said fastener is retained within said chamber.

6. The fluorescent lamp fixture of claim 1, further comprising a lens coupled with said housing.

7. The fluorescent lamp fixture of claim 1, wherein said metal strip is aluminum.

8. The fluorescent lamp fixture of claim 1, wherein said metal strip is fixed to said sides of said groove and said housing top with an adhesive.

9. The fluorescent lamp fixture of claim 1, further comprising one or more fasteners slidably held by said strip, said fasteners adapted to secure the ballast in direct contact with said flange.

10. A fluorescent lamp fixture for mounting a ballast and at least one fluorescent lamp, said fixture comprising:

a molded housing having a top and sides, said top having a groove extending a major portion of the length of said housing, said groove presenting at least two sides and an opening;

a hat-shaped metal strip comprising an outer wall having at least two surfaces in contact with said sides of said groove, a pair of inner walls positioned relative to said outer wall so as to define a chamber, and two flanges extending outside of said groove for contact with said housing top;

at least one fastener slidably held by said strip, wherein a portion of said fastener is retained within said chamber and said fastener is adapted to secure the ballast in direct contact with said flanges whereby heat from the ballast is transferred to said metal strip and dissipated from said housing during use.

11. A method of extending the life of a ballast used in conjunction with a fluorescent lamp in a fluorescent lamp fixture, comprising:

providing a molded housing, said housing defining a groove along a major portion of the length of said housing;

providing a metal strip fixed within said groove;

mounting said ballast in direct contact with said strip, wherein said strip conducts heat away from said ballast during use.

12. The fluorescent lamp fixture of claim 11, wherein said metal strip is aluminum.

* * * * *